United States Patent [19]

Muka

[11] 4,070,015

[45] Jan. 24, 1978

[54] SHEET FEEDING APPARATUS

[75] Inventor: Richard Stephen Muka, Rochester, N.Y.

[73] Assignee: Eastman Kodak Company, Rochester, N.Y.

[21] Appl. No.: 735,233

[22] Filed: Oct. 26, 1976

[51] Int. Cl.[2] ..... B65H 3/10

[52] U.S. Cl. ..... 271/100; 271/108

[58] Field of Search ..... 271/99, 100, 108, 107, 271/96, 94, 101, 98; 214/8.5 D

[56] References Cited

U.S. PATENT DOCUMENTS

| | | | |
|---|---|---|---|
| 1,888,194 | 11/1932 | Broadmeyer | 271/98 |
| 2,849,232 | 8/1958 | Halahan et al. | 271/98 |
| 3,218,061 | 11/1965 | Rabinow | 271/100 X |
| 3,287,011 | 11/1966 | Currie | 271/107 X |
| 3,674,255 | 7/1972 | Arnell | 271/99 X |
| 3,904,190 | 9/1975 | Kuehn | 271/108 X |

FOREIGN PATENT DOCUMENTS

| | | | |
|---|---|---|---|
| 1,398,061 | 6/1975 | United Kingdom | 271/108 |

*Primary Examiner*—Bruce H. Stoner, Jr.
*Attorney, Agent, or Firm*—Lawrence P. Kessler

[57] ABSTRACT

Sheet feeding apparatus including a direct acting vacuum control value for an oscillating vacuum feeder. The control valve includes a valve shoe normally biased to a position to cover a vent port in the housing of the oscillating vacuum feeder. An appropriate linkage, interconnected to the shoe, is actuated to uncover the vent port for at least a portion of the oscillation cycle of the oscillating vacuum feeder, whereby the vacuum within the oscillating vacuum feeder is vented to release pneumatic forces on the sheets during at least the return portion of the oscillation cycle.

5 Claims, 4 Drawing Figures

FIG. 1

SHEET FEEDING APPARATUS

BACKGROUND OF THE INVENTION

1. Field of the Invention

This invention relates to vacuum sheet feeding apparatus, and more particularly to a valve for controlling the vacuum supply for an oscillating vacuum sheet feeder.

2. Description of the Prior Art

In high speed printing apparatus or electrophotographic copier/duplicators, it is common pratice to feed precut sheets from a stack seriatim. The sheet feeding precut sheets from a stack seriatim. The sheet feeding apparatus may be either of the mechanical or the vacuum type. Mechanical feeding apparatus, such as scuff feeders or belt transports, require frictional interaction with the sheet to induce sheet movement. Vacuum feeding apparatus on the other hand, use pneumatic forces to maintain a sheet in contact with the feeder as the feeder is moved. One of the advantages of using vacuum feeding apparatus is that such apparatus may be more easily controlled to better assure pickup of a single sheet from a stack, decreasing the possibility of plural sheet feeds.

One type of vacuum feeding apparatus which is extremely efficient for feeding sheets at a desired high rate of speed is an oscillating vacuum feeder. The oscillating vacuum feeder generally includes an oscillating cylindrical housing which is connected to a vacuum source. The housing has a series of ports which permits the vacuum to be effective to tack one sheet from a stack of sheets to the housing. The oscillation of the housing feeds the tacked sheet from the stack into engagement with a nip roller in contact with the housing at a point remote from the stack. Circumferential bearings supported by the housing permit the sheet to continue in its feed path during return oscillation cycle of the housing (to return the vacuum ports to the point where feed of the next sheet from the stack is initiated). An example of such an oscillating vacuum feeder is shown in U.S. Pat. No. 2,770,458.

Under certain circumstances the oscillating vacuum feeders of the type described above have been ineffective for reliable high speed sheet feeding. Particularly the pneumatic forces exerted on the sheets being fed by the vacuum during the return oscillation cycle may disrupt the sheet feeding by creating undue drag forces on the sheets or by inducing excess static charge generation on the sheets. In order to overcome these potential problems, some prior art apparatus have employed mechanisms for interrupting the vacuum during the return oscillation cycle (see for example U.S. Pat. No. 3,764,255). Such apparatus has heretofore been of complex configuration requiring complicated electromechanical cut-off valves or intricate internal valve construction within the oscillating vacuum feeder housing.

SUMMARY OF THE INVENTION

It is a purpose of this invention to provide a direct acting valve of simple construction for controlling the vacuum supply for an oscillating vacuum sheet feeder. The valve includes a valve shoe normally biased to a position to cover a vent port in the housing of the oscillating vacuum feeder. An appropriate linkage, interconnected to the shoe, is actuated to uncover the vent port for at least a portion of the oscillation cycle of the oscillating vacuum feeder cycle, whereby the vacuum within the oscillating vacuum feeder is vented to release pneumatic forces on the sheets during at least the return portion of the oscillation cycle.

The invention, and its objects and the advantages, will becme more apparent in the detailed description of the preferred embodiments presented below.

DESCRIPTION OF THE PREFERRED EMBODIMENTS

Figure 1:
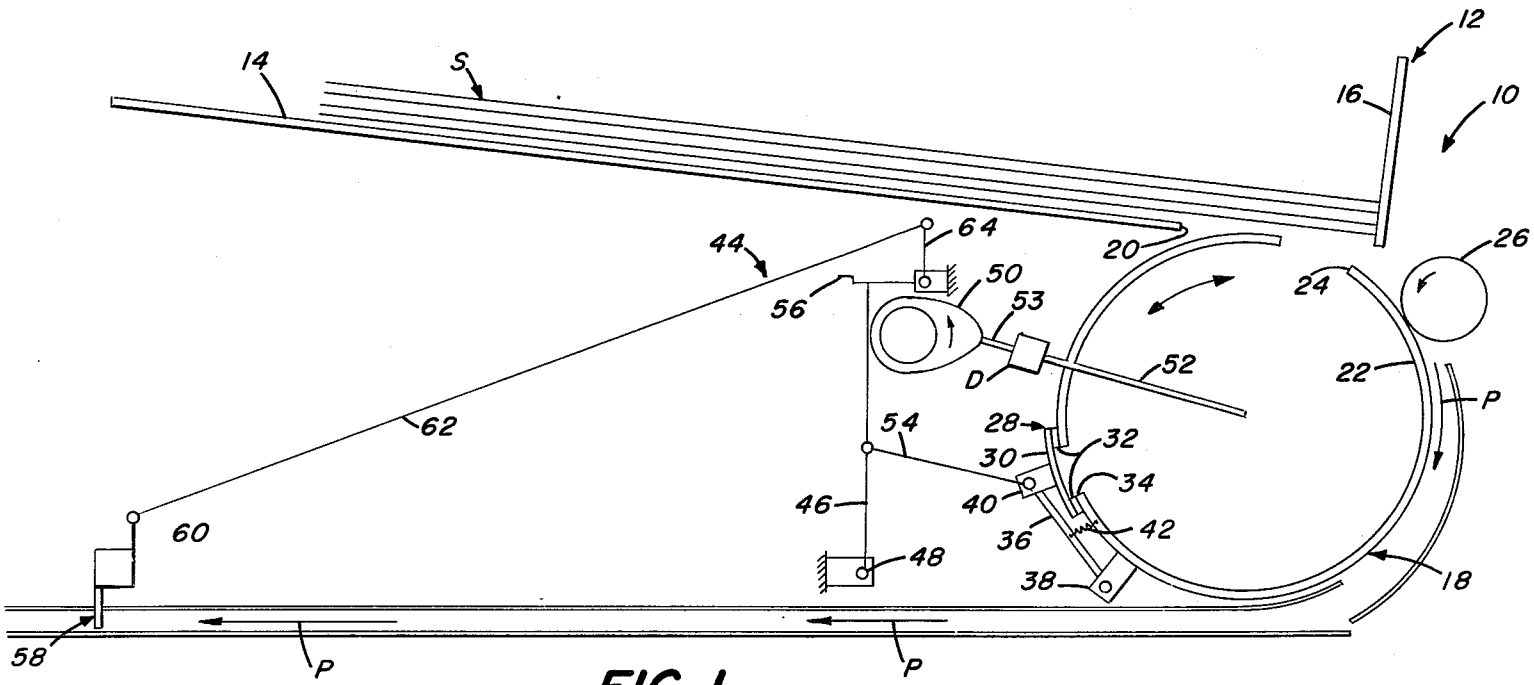
FIGS. 1 through 3 are side elevational views, partly in section, of an oscillating vacuum feeder incorporating the vacuum control valve according to this invention, the oscillating vacuum feeder and the control valve being shown in various positions during the oscillation cycle.

Referring now to the drawings, the sheet feeding apparatus 10 includes a hopper 12 having a support tray 14 for supporting a stack of cut sheets S, the tray being angled from the horizontal toward a forward wall 16 to provide for gravity aided registration of the sheets against the forward wall. An oscillating vacuum feeder is located beneath the tray 14 for initiating the feeding of the sheets seriatim from the hopper along a path P. The support tray 14 has an opening 20 adjacent the forward wall 16 to expose the stack to the action of the oscillating vacuum feeder 18.

The oscillating vacuum feeder 18 has a tubular housing 22 to which a vacuum source is coupled in a manner not specifically shown. The housing 22 has a series of ports 24 (one shown) located along the longitudinal axis of the housing. The oscillating vacuum feeder 18 is oscillated by any known oscillating means, such as the schematically shown drive mechanism D and drive shaft 52, between the position of FIG. 1 wherein the ports 24 of the housing 22 generally underlie the opening 20 and the position of FIG. 2 wherein a sheet drawn to the housing 22 by the pneumatic forces induced by the vacuum within the housing will be fed from the stack in the hopper 12 to a nip roller 26. The nip roller 26 is constantly rotated in a counter clockwise direction to drive the sheets stripped from the stack along the feed path P.

As noted hereinabove, if the vacuum within the housing 22 is not interrupted on the return portion of the oscillation cycle, undue drag forces will be exerted on the sheet being fed forward along the path P by the nip roller 26. The drag forces can have deleterious effects on sheet handling such as by accentuating steering tendencies of the nip roller on the sheets being fed inducing excess static charge generation on the sheets, or wrinkling of the trailing edge of the sheets as they pass over the ports 24. Therefore, the oscillating vacuum feeder 18 is provided with a vacuum control valve 28 for selectively venting the feeder.

Figure 2:
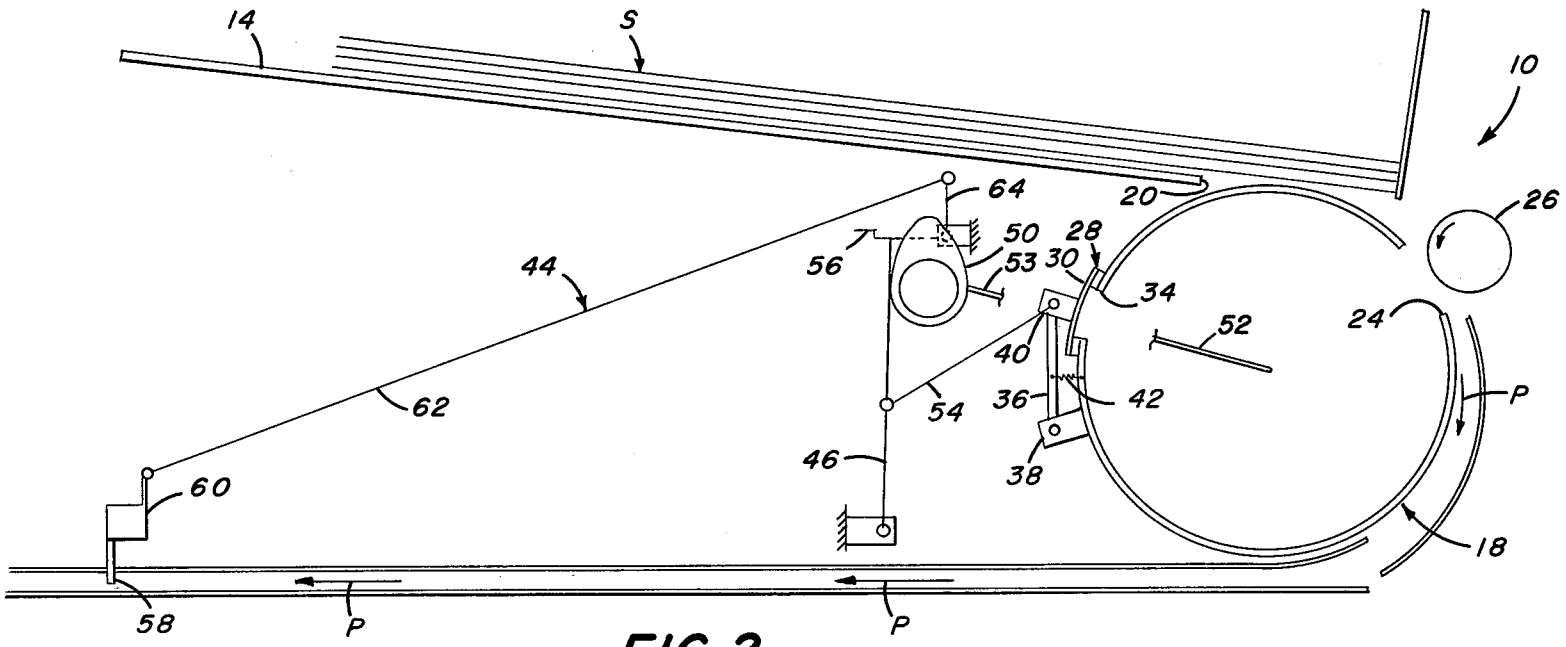
Figure 3:
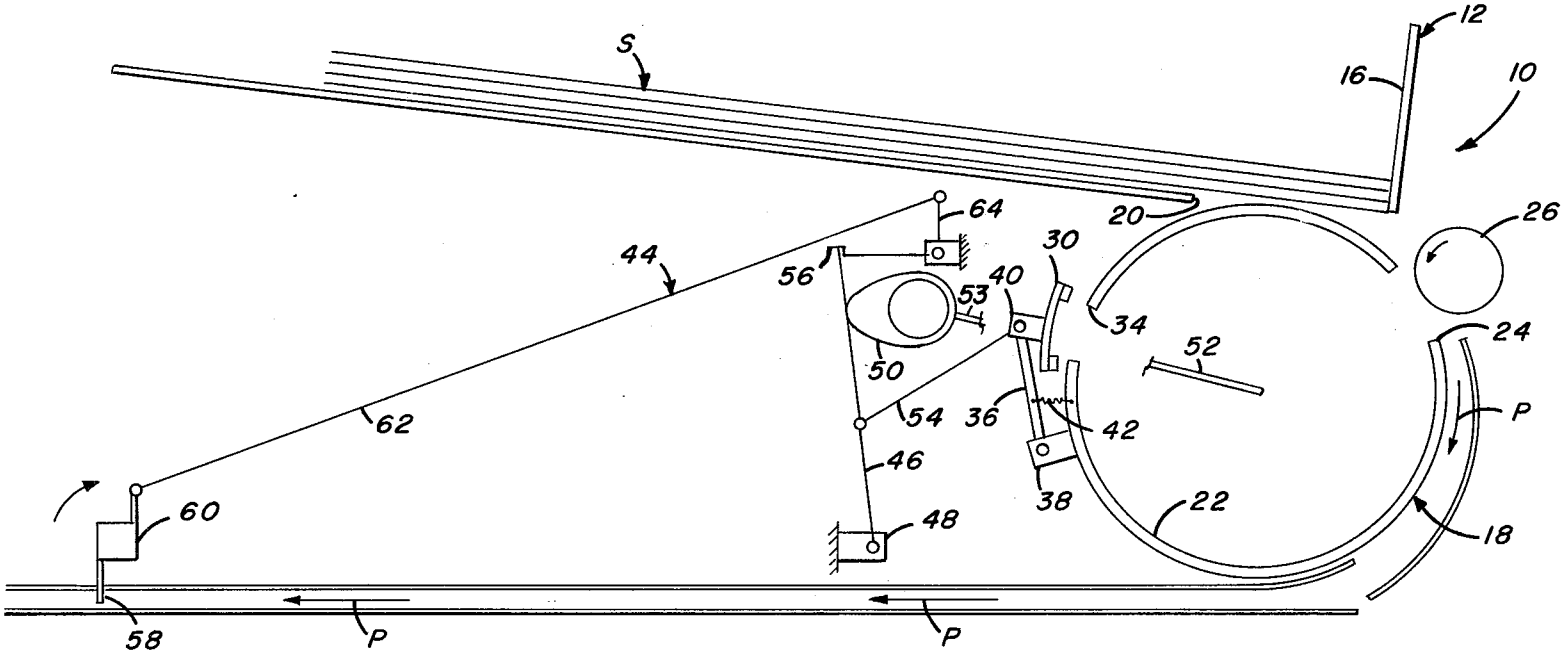

In the embodiments of FIGS. 1 through 3, the vacuum control valve includes a valve shoe 30 of a complimentary shape to the housing 22. The valve shoe 30, which has a sealant material 32 fixed to its marginal edges, is positioned to normally close a vent port 34. A lever arm 36 pivotally supported by a bracket 38 extending radially from the housing 22, is pivotally connected at its opposite end to a bracket 40 mounted on the shoe 30. A tension spring 42 connected at one end to the lever arm 36 and at the other to the housing 22 biases the valve shoe 30 to its closed position. The opening of the valve shoe 30 is controlled by a linkage arrangement 44.

The linkage arrangement 44 comprises, in part, a first link 46 which is pivotally supported at one end 48 and is moved by a cam 50 which is rotated by the shaft 53 rotatably coupled to the oscillating vacuum feeder drive mechanism D A link 54 is pivotally connected between the bracket 40 on the shoe 30 and the link 46 at a point mid-way between the pivot end 48 and the point of engagement of the cam 50 with the link 46. In operation, with the structure as shown in FIG. 1, the housing 22 of the oscillating vacuum feeder 18 is positioned to locate ports 24 beneath the opening 20. Thus when the vacuum is activated within the housing 22, the bottom most sheet in the hopper 12 will be drawn to the housing by vacuum induced pneumatic forces. The housing 22 will then be oscillated to its position of FIG. 2 in one quarter revolution of the drive shaft 52 through the drive mechanism D wherein the sheet tacked to the housing will be fed to the nip roller 26. During the remainder of the cycle of the oscillating vacuum feeder 18, the sheet will be under the control of the nip roller 26 whereby the sheet will be fed along the path P. The drive mechanism D, upon continued rotation of the drive shaft 52, after a dwell period (second quarter revolution of the drive shaft 52) will reverse the direction of movement of the housing 22 to provide the reverse oscillation cycle.

During the dwell period (second quarter of revolution), the cam 50 will be rotated by shaft 53 to cause the link 46 to pivot counterclockwise about its end 48 to the position shown in FIG. 3. Pivoting of link 46 will move link 54 which moves the valve shoe 30 opening the vent port 34 whereby the vacuum within the housing 22 will be vented. The link 46 is cammed to a position where it is engaged by a pawl 56 which latches the link 46 in such position to maintain the valve shoe 30 in its open position during the third quarter of revolution of the drive shaft 52 in which the housing 22 is oscillated back to its position of FIG. 1 and the cam 50 is rotated by shaft 53 to a position with its lobe facing downward During the fourth quarter of revolution of the drive shaft 52 (a dwell period for the housing 22), the fed sheet will pass a sensor 58. The sensor 58 is fixed to a support 60 which is pivoted in a clockwise direction by engagement of the sheet with the sensor 58. A link 62 is pivotally connected between the support 60 and a link 64 which is in turn fixedly connected to the pawl 56. When the link 62 is moved by the support 60, it will rotate the link 64 in a clockwise direction moving the pawl 56 to release the link 46. When the link 46 is released, the valve shoe 30 will be free to return to its position wherein the vent port 34 is closed, under the influence of the spring 42 and lever arm 36, reestablishing the vacuum within the housing 22 for feeding of subsequent sheets.

Figure 4:
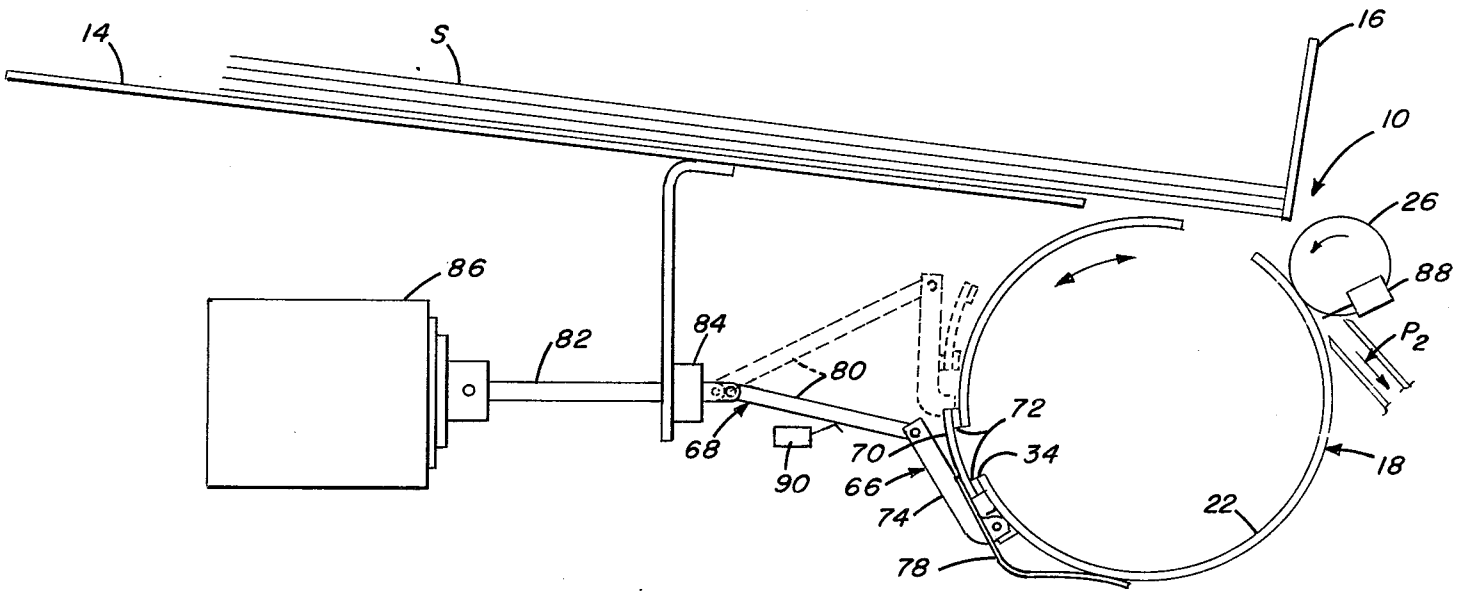
FIG. 4 is a side elevational view, partly in section, of an oscillating vacuum feeder incorporating a modified vacuum control valve according to this invention.

In the alternate embodiment of FIG. 4, the structure of the oscillating vacuum feeder 18 and its operation are the same as discussed above. The vacuum control valve 66 for opening the vent port 34, and its actuating mechanism 68, are of a somewhat different construction. The valve 66 includes a valve shoe 70 with a sealant material 72 fixed to its marginal edges. The valve shoe 70 is fixed to an arm 74 pivotally connected to a bracket 76 on the housing 22. A leaf spring 78 connected at one end to the housing 22 biases the shoe 70 to its position for sealing the port 34. A link 80 is pivotally connected at one end to the arm 74 at its opposite end to a reciprocating rod 82. The rod 82, which is supported in a bearing block 84, is reciprocated by a solenoid 86.

As in the operation of the first described embodiment, vacuum established within the housing 22 of the oscillating vacuum feeder 18 will induce pneumatic forces to tack a sheet to the housing and feed the sheet from the hopper 12 to the nip roller 26 as the housing rotates in the clockwise direction. During this period of oscillation, the spring 78 will maintain the valve shoe 70 in its closed position relative to the port 34. As the nip roller 26 feeds the sheet along the path $P_2$, the sheet will activate a sensor 88 which will generate a signal to actuate the solenoid 86 to retract the rod 82. Retraction of the rod 82 will move the link 80 to pivot the arm 74 against the bias of the spring 78. The movement of the arm 74 causes the shoe 70 to move to its open (dotted line portion of FIG. 4) thus venting the vaccum within the housing 22. The shoe 70 will remain in its open position during the reverse oscillation cycle of the oscillating vacuum feeder 18. When the housing 22 returns to its initial position, the link 80 will contact a sensor 90 which will generate a signal to deactuate the solenoid 86. Upon deactuation, the rod 82 will be extended to its initial position which will allow the valve shoe 70 to be closed by the spring 78 to seal the port 34, whereby the vacuum may be reestablished within the housing 22 for subsequent sheet feeding.

From the foregoing it is apparent that there is herein provided a vacuum control valve for an oscillating vacuum feeder of simple and efficient construction. A vacuum shoe is normally biased to close a vacuum vent port in the oscillating vacuum feeder. An appropriate linkage mechanism opens the vacuum shoe to vent the vacuum within the oscillating vacuum feeder during at least the return portion of the oscillation cycle thereof. The venting of the vacuum fascilitates sheet feeding by reducing both drag on the sheets and induced static charge.

The invention has been described in detail with particular reference to preferred embodiments thereof, but it will be understood that variations and modifications can be effected within the spirit and scope of the invention.

I claim:

1. In an oscillating vacuum feeder for feeding sheets seriatim from a sheet stack along a sheet travel path, said oscillating vacuum feeder including a tubular housing having at least one port through the wall of said housing, means for oscillating said tubular housing along said sheet travel path between a first position wherein said one port is located adjacent to said sheet stack and a second position remote from said first position, and wherein a sheet is tacked to said tubular housing by pneumatic forces created by a vacuum applied to the inside of said tubular housing when said tubular housing is in said first position, whereby during at least a portion of the oscillating movement of said tubular housing from the first position to its second position, the tacked sheet is moved along said travel path, and a vacuum vent port located through the wall of said housing, a control valve operatively associated with said vacuum vent port, said control valve comprising:

a movable valve shoe mounted on said tubular housing for opening and closing said vacuum vent port;

means for resiliently urging said valve shoe to a first position in which said vacuum vent port is closed;

linkage means for moving said valve shoe to a second position in which said vacuum vent port is open; and control means for actuating said linkage means to open the vent port and relieve the vacuum within said tubular housing during the movement of said housing from said second position to said first position, thereby releasing the tacked sheet for further movement along said sheet travel path.

2. The invention of claim 1 wherein said control means includes a shaft rotatably driven by said oscillating means and a cam fixed on said shaft and positioned in engagement with said linkage means for cyclically actuating said linkage means.

3. The invention of claim 2 wherein said linkage means includes a first pivotable link engageable by said cam, said link being movable by said cam between a first position and a second position; a second link pivotably connected at one end to said valve shoe and at the other end to said first link, said second link positioning said valve shoe in its second position when said first link is moved to its second position.

4. The invention of claim 3 wherein said linkage means further includes a pawl for latching said first link in the second position, and means for moving said pawl to release said first link prior to the next oscillation of said housing from its first position to its second position.

5. The invention of claim 1 wherein said control means includes a solenoid operatively connected to said linkage means for actuating said linkage means, a first sensor for sensing when said housing has moved to its second position and in response thereto producing a solenoid actuating signal, and a second sensor for sensing when said housing has returned to its first position and in response thereto, producing a solenoid deactuating signal.

* * * * *

UNITED STATES PATENT AND TRADEMARK OFFICE

CERTIFICATE OF CORRECTION

PATENT NO. : 4,070,015

DATED : January 24, 1978

INVENTOR(S) : Richard S. Muka

It is certified that error appears in the above-identified patent and that said Letters Patent are hereby corrected as shown below:

Col. 1, line 54 change U.S.Patent No. to read

--- 3,674,255 ---

Signed and Sealed this

Ninth Day of May 1978

[SEAL]

Attest:

RUTH C. MASON
Attesting Officer

LUTRELLE F. PARKER
Acting Commissioner of Patents and Trademarks